United States Patent [19]

Lowy

[11] 4,270,751

[45] Jun. 2, 1981

[54] GOLF PUTTING AID APPARATUS FOR THE VISUALLY HANDICAPPED

[76] Inventor: Stephen D. Lowy, 8 Spruce Rd., Monsey, N.Y. 10952

[21] Appl. No.: 74,796

[22] Filed: Sep. 12, 1979

[51] Int. Cl.[3] ..... A63B 57/00; A63B 69/36

[52] U.S. Cl. ..... 273/34 R; 273/184 A; 273/381; 46/175 R; 340/323 R

[58] Field of Search ..... 273/184 R, 184 A, 185 A, 273/381, 34 R, DIG. 27, 213, 58 G, 179 C, 177 A, 177 R, 382, 178 A; 340/323 R

[56] References Cited

U.S. PATENT DOCUMENTS

| | | | |
|---|---|---|---|
| 1,620,290 | 3/1927 | Rubin | 273/213 |
| 1,689,475 | 10/1928 | Brumder | 273/179 C |
| 2,719,719 | 10/1955 | Sherwan | 273/177 A |
| 2,737,392 | 3/1956 | Stokes | 273/177 A |
| 3,782,730 | 1/1974 | Horchler | 273/213 |
| 3,935,669 | 2/1976 | Potrzuski | 273/58 G |
| 4,120,496 | 10/1978 | Niina | 273/184 A X |

OTHER PUBLICATIONS

"Radio-Electronics", Dec. 1971, p. 14.

*Primary Examiner*—George J. Marlo
*Attorney, Agent, or Firm*—Hubbell, Cohen, Stiefel & Gross

[57] ABSTRACT

A golf putting aid apparatus for a visually handicapped person which is capable of use with a standard type golf cup is provided in which an audibly distinguishable electronic sound emission is provided for audibly indicating to the visually handicapped person the location of the golf cup or hole and a second audibly distinguishable electronic sound emission is provided for audibly indicating to the visually handicapped person that a putt has been successfully completed. The putting aid apparatus comprises a housing, such as one removably insertable in the golf cup so that it may be transferred from hole to hole during regulation play on a golf course. The housing has a golf ball receiving portion and an audible electronic sound emitting portion with the ball receiving portion having an entrance portion alignable in the golf cup for receiving a golf ball putted thereinto.

11 Claims, 2 Drawing Figures

GOLF PUTTING AID APPARATUS FOR THE VISUALLY HANDICAPPED

BACKGROUND OF THE INVENTION

1. Field of the Invention

The present invention relates to golf putting aids, and particularly to such putting aids for the visually handicapped.

2. Description of the Prior Art

Devices to assist in practicing putting are well known, such as disclosed in U.S. Pat. Nos. 1,689,475; 2,737,392 and 2,719,719. All of these prior art practice putting devices involve some type of an alarm mechanism, such as a bell, or an electronic alarm, such as disclosed in U.S. Pat. Nos. 1,689,475 and 2,719,719, for indicating to the player when a practice putt has been successfully completed. However, these prior art practice putting devices are not intended for use on a standard golf course in conjunction with a standard type golf cup and, moreover, are not intended or designed for use by the visually handicapped so as to both assist such a visually handicapped person in locating the hole into which the putt is to be made as well as indicating to that person that the putt has been successfully completed. Thus, these prior art putting practice devices are primarily designed for normally sighted persons and do not generally consider the problems of the visually handicapped. Similarly, in considering the problems of normally sighted persons, electronic golf balls have been developed, such as disclosed in U.S. Pat. Nos. 1,620,290; 3,782,730 and 3,935,669, for purposes of assisting a normally sighted person in locating a lost golf ball by means of an audible electronic sound which is emitted from the golf ball. Although such a golf ball may also be used by a visually handicapped person in order to locate the ball by sound, this does not assist such a visually handicapped person in putting the located ball into a hole or golf cup which cannot be seen by the visually handicapped person. Thus, once again, the problems of the visually handicapped in attempting to lead a normal life and participate in similar sports activities as their normally sighted counterparts have not been adequately considered and taken into account in the prior art. These disadvantages of the prior art are overcome by the present invention.

SUMMARY OF THE INVENTION

A golf putting aid apparatus for a visually handicapped person which is capable of use with a standard type golf cup is provided in which an audibly distinguishable electronic sound emission is provided for audibly indicating to the visually handicapped person the location of the golf cup or hole and a second audibly distinguishable electronic sound emission is provided for audibly indicating to the visually handicapped person that a putt has been successfully completed. The putting aid apparatus comprises a housing, such as one removably insertable in the golf cup so that it may be transferred from hole to hole during regulation play on a golf course. The housing has a golf ball receiving portion and an audible electronic sound emitting portion with the ball receiving portion having an entrance portion alignable in the golf cup for receiving a golf ball putted thereinto. The audible electronic sound emission portion comprises an audible alarm means, such as a buzzer arrangement, capable of providing at least two different audibly distinguishable electronic sound emissions, a power supply, such as a conventional battery, operatively connected to the electronic alarm for providing power thereto, a bistable switch having a first open circuit state and a second closed circuit state with the bistable switch arming the audible alarm in the second state for providing the first audibly distinguishable electronic sound emission for audibly indicating to the visually handicapped person the location of the golf cup in which the housing has been inserted, and a spring biased golf ball activated switch having a first state and a second state with the first state being a stable state in which the ball activated switch is in a spring biased normal open circuit condition with no ball in the ball receiving portion, and with said second state being a state in which the ball activated switch is in a closed circuit condition with a ball resting in the ball receiving portion. The ball activated switch comprises a spring biased member normally biased to the open circuit condition by a predetermined spring biased force which is selected to be less than the force exerted by the received ball due to the weight of the ball. The spring biased member is disposed in the ball receiving portion for enabling pressure contact with a ball received therein for enabling the weight of the received ball to overcome the spring bias force to place the ball activated switch into the second state. The ball activated switch arms the audible alarm in this second state for providing the second audibly distinguishable electronic sound emission for audibly indicating to the visually handicapped person that a putt has been successfully completed whereby when the bistable switch is armed the golf cup is audibly located for subsequent putt whose successful completion is audibly indicated when the ball activated switch is armed. The audibly distinguishable electronic sound emissions may be different tones with one emission being a continuous tone and the second emission being a different continuous tone or with one emission being a continuous tone and the second emission being an intermittent tone.

DETAILED DESCRIPTION OF THE PREFERRED EMBODIMENT

Figure 1:
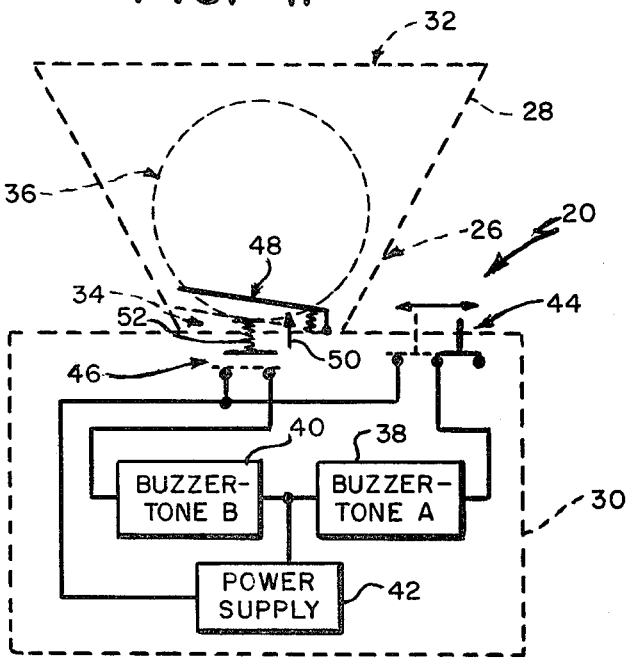
FIG. 1 is a schematic diagram, partially in block, of the presently preferred embodiment of the present invention.
Figure 2:
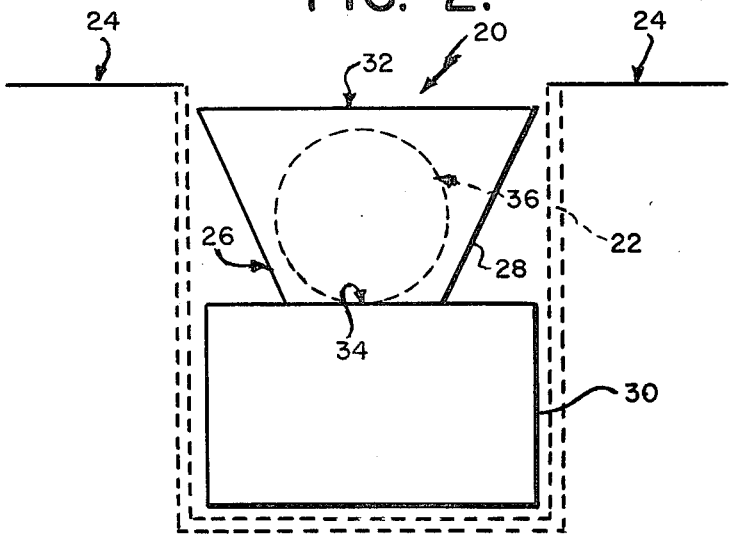
FIG. 2 is a diagrammatic illustration of the presently preferred embodiment of the present invention shown in the environment in which it is preferably employed.

Referring now to the drawings in detail and initially to FIG. 1 thereof, a schematic diagram of the presently preferred embodiment of the golf putting aid apparatus of the present invention, generally referred to by the reference numeral 20, is shown. The golf putting aid apparatus 20 of the present invention is preferably designed for use by the visually handicapped so as to enable such a visually handicapped person to audibly locate a golf cup or hole on a standard golf course and to thereafter receive an audible indication when the putt has been successfully completed. In this regard, the golf putting aid apparatus 20 of the present invention is preferably designed so as to be removably insertable in a standard type golf cup employed on conventional golf courses, such as diagrammatically illustrated in FIG. 2, wherein the golf cup is represented by reference numeral 22 and the putting green is represented by reference numeral 24. As shown and preferred in FIGS. 1 and 2, the golf putting aid 20 of the present invention preferably includes a housing 26 having a golf ball receiving portion 28 and an audible electronic sound emitting portion 30. The golf ball receiving portion 28 preferably comprises a frustum of a cone and has an entrance portion 32 and a bottom portion 34. Preferably, the diameter of the entrance portion 32 is chosen so as to be substantially equal to the diameter of a standard type golf cup 22 into which the putting aid 20 is to be inserted. Similarly, the diameter of the bottom portion 34 is preferably chosen so as to be substantially equivalent to the diameter of a conventional golf ball 36 of the type normally received through the entrance portion 32 when the putting aid 20 is in use. As shown and preferred in FIG. 2, the entrance portion 32 is preferably substantially aligned in the golf cup 22 with the lip of the cup 22 for enabling reception of a golf ball 36 putted thereinto from the putting green 24.

As shown and preferred in FIG. 1, the audible electronic sound emitting portion 30 preferably includes an audible alarm, such as preferably a pair of conventional buzzers 38, 40 having two different audibly distinguishable electronic sound emissions or tones, referred to as tone A for buzzer 38 and tone B for buzzer 40. These buzzers 38, 40 are preferably powered by a conventional portable power supply 42, such as a DC battery. In addition to buzzers 38, 40 and power supply 42, the audible electronic sound emitting portion 30 also preferably includes a pair of switches 44, 46, with switch 44 preferably being a conventional bistable slide switch, and with switch 46 preferably being a conventional weight activated switch. In the circuit illustrated in FIG. 1, switch 44 controls the operation of buzzer 38 and switch 46 controls the operation of buzzer 40. Referring initially to switch 44, this bistable switch is shown in solid lines in the open circuit condition and in dotted lines in the closed circuit condition, with the buzzer 38 being connected to power supply 42 in the closed circuit condition only. Similarly, switch 46 is shown in solid lines in the open circuit condition and in dotted lines in the closed circuit condition, with buzzer 40 being connected to power supply 42 only in the closed circuit condition. Weight activated switch 46 preferably includes a resiliently biased member 48, such as a spring biased member or a bimetallic element, which is normally resiliently biased into the open circuit condition in the direction of arrow 50 by a predetermined resilient biased force. This resilient biased force is preferably selected to be less than the force exerted by a received golf ball 36 due to its associated weight. Switch 46 also includes a resiliently biased switch contact 52 which is moved into the closed circuit condition by pressure contact with member 48 when pressure contact by a golf ball 36 is made with member 48 by the ball 36 being received into the ball receiving portion 28 and thereafter resting on member 48, with the associated weight of the golf ball 36 thereafter keeping switch 46 in the closed circuit condition until the golf ball 36 is removed.

In using the golf putting aid apparatus 20 of the present invention, the apparatus 20 is placed in the golf cup 22 prior to the visually handicapped person attempting a putt. The caddy would then move switch 44 to the closed circuit condition and buzzer 38 would preferably emit a continuous audibly distinguishable tone which would then audibly locate the hole 22 for the visually handicapped person. The putt would thereafter be attempted in the direction of the audibly located hole 22 and, if successfully completed, the ball 36 would drop into the ball receiving portion 28 and thereafter come to rest on member 48 thereby causing switch 46 to be placed into the closed circuit condition. Upon placement of switch 46 into the closed circuit condition, buzzer 40 would then emit its own audibly distinguishable tone to indicate to the visually handicapped person that the putt had been successfully completed. If the putt were not successfully completed, the caddy could assist the visually handicapped person in locating the ball or, if desired, an electronic golf ball, such as the type described in U.S. Pat. No. 3,782,730, could be employed to audibly locate the golf ball. In such an instance, the frequency or tone of the buzzers 38 and 40 should be chosen to be different than that of the electronic golf ball so that the ball could also readily be audibly located by the visually handicapped person. When the putt is successfully completed, the putting aid 20 could be removed from the golf cup 22 and carried by the caddy to the next hold to be played during the round of golf and re-used again in the same manner.

Of course, if desired, buzzers 38 and 40 could be replaced by a single buzzer having the capability of emitting two audibly distinguishable tones to initially indicate the location of the hole and subsequently completion of a successful putt, could include a conventional interrupter for causing the first electronic sound emission to be a continuous tone to locate the hold and the second electronic sound emission to be an intermittent tone, such as a beep, to indicate successful completion of the putt which beep could be electronically produced from the original continuous tone or from a separate tone, if desired, or any other type of electronic sound emission readily distinguishable by a visually handicapped person.

It should be noted that preferably the housing 26 is made of a light weight material so as to be readily transportable from hole to hole during normal golf play.

In summarizing the operation of the golf putting aid apparatus 20 of the present invention, when the bistable switch 44 is armed or placed into the closed circuit condition, the golf cup 22 is audibly located for a subsequent putt whose successful completion is audibly indicated to the visually handicapped person when the ball activated switch 46 is armed or placed into the closed circuit condition.

What is claimed is:

1. A golf putting aid apparatus for a visually handicapped person capable of use with a standard type golf cup, said putting aid comprising a housing insertable in said golf cup, said housing having a golf ball receiving portion and an audible electronic sound emitting portion, said ball receiving portion having an entrance portion alignable in said golf cup for receiving a golf ball putted thereinto, said audible electronic sound emitting portion comprising an audible alarm means capable of providing at least two different independently selectable audibly distinguishable electronic sound emissions, a power supply operatively connected to said electronic alarm means for providing power thereto, bistable switch means having a first open circuit state and a second closed circuit state, said bistable switch means arming said audible alarm means in said second state for providing a first independently selectable audibly distinguishable electronic sound emission for audibly indicating to said visually handicapped person the location of the golf cup in which said housing has been inserted, and spring biased golf ball activated switch means having a first state and a second state for providing a different second independently selectable audibly distinguishable electronic sound emission for audibly indicating to said visually handicapped person that a putt has been successfully completed, said first state being a stable state in which said ball activated switch means is in a resiliently biased normal open circuit condition with no ball in said ball receiving portion, said second state being a state in which said ball activated switch means is in a closed circuit condition with a ball resting in said ball receiving portion, said ball activated switch means comprising a resiliently biased member normally resiliently biased to said open circuit condition by a predetermined resilient bias force, said resilient bias force being selected to be less than the force exerted by a received ball due to the weight of the ball, said resiliently biased member being disposed in said ball receiving portion for enabling pressure contact with a ball received therein for enabling the weight of said received ball to overcome said resilient bias force to place said ball activated switch means into said second state, said ball activated switch means arming said audible alarm means in said second state for providing said second audibly distinguishable electronic sound emission, whereby when said bistable switch is armed said golf cup is initially uniquely audibly located for a subsequent putt whose successful completion is subsequently uniquely audibly indicated when said ball activated switch is armed.

2. An apparatus in accordance with claim 1 wherein said housing is removably insertable in said golf cup.

3. An apparatus in accordance with claim 2 wherein said golf cup is substantially cylindrical having a predetermined diameter, said ball receiving portion comprises a frustum of a cone having a bottom portion below said entrance portion, said entrance portion having substantially the diameter of said golf cup and said bottom portion having substantially the diameter of said golf ball to be received through said entrance portion, said resiliently biased member being disposed in said bottom portion for activation by said received golf ball.

4. An apparatus in accordance with claim 3 wherein said first audibly distinguishable electronic sound emission is a continuous tone and said second audibly distinguishable electronic sound emission is a different continuous tone.

5. An apparatus in accordance with claim 3 wherein said first audibly distinguishable electronic sound emission is a continuous tone and said second audibly distinguishable electronic sound emission is an intermittent tone.

6. An apparatus in accordance with claim 1 wherein said audible alarm means comprises a buzzer.

7. An apparatus in accordance with claim 1 wherein said power supply comprises a battery.

8. An apparatus in accordance with claim 1 wherein said first audibly distinguishable electronic sound emission is a continuous tone and said second audibly distinguishable electronic sound emission is a different continuous tone.

9. An apparatus in accordance with claim 1 wherein said first audibly distinguishable electronic sound emission is a continuous tone and said second audibly distinguishable electronic sound emission is an intermittent tone.

10. An apparatus in accordance with claim 9 wherein said ball activated switch means further comprises interrupter means for providing said intermittent tone when said ball activated switch means is armed.

11. An apparatus in accordance with claim 1 wherein said audible alarm means comprises means for producing said different second electronic sound transmission from said first sound transmission in said second state of said bistable switch means.

* * * * *